US010460886B2

(12) United States Patent
Jones

(10) Patent No.: US 10,460,886 B2
(45) Date of Patent: Oct. 29, 2019

(54) SINGLE PHASE UNDERGROUND FUSED TAP

(71) Applicant: Robert K. Jones, Sierra Vista, AZ (US)

(72) Inventor: Robert K. Jones, Sierra Vista, AZ (US)

( * ) Notice: Subject to any disclaimer, the term of this patent is extended or adjusted under 35 U.S.C. 154(b) by 0 days.

(21) Appl. No.: 16/258,541

(22) Filed: Jan. 26, 2019

(65) Prior Publication Data

US 2019/0237275 A1 Aug. 1, 2019

Related U.S. Application Data

(60) Provisional application No. 62/622,763, filed on Jan. 26, 2018.

(51) Int. Cl.

| | |
|---|---|
| ***H01H 9/10*** | (2006.01) |
| ***H01H 85/20*** | (2006.01) |
| ***H01H 85/042*** | (2006.01) |
| ***H01H 9/08*** | (2006.01) |
| ***H01H 85/22*** | (2006.01) |

(52) U.S. Cl.

CPC ..... *H01H 9/102* (2013.01); *H01H 9/085* (2013.01); *H01H 85/042* (2013.01); *H01H 85/205* (2013.01); *H01H 85/22* (2013.01)

(58) Field of Classification Search

CPC ..... H01H 85/205; H01H 9/102; H01H 85/20; H01H 85/22; H01H 9/085; H01R 13/68; H01R 13/684

See application file for complete search history.

(56) References Cited

U.S. PATENT DOCUMENTS 2,637,795 A * 5/1953 Hubbard ..... H01R 11/15 200/48 R
2,700,085 A * 1/1955 Breisch ..... H01H 85/201 337/201
2,836,682 A * 5/1958 Matthysse ..... H01R 25/006 174/59
3,512,118 A * 5/1970 Leonard ..... H01H 9/102 174/18
3,551,869 A * 12/1970 Robinson ..... H01H 85/201 337/201
3,559,141 A * 1/1971 Hardy ..... H01H 85/20 174/73.1
3,692,921 A * 9/1972 Yonkers ..... H01R 11/00 174/72 R
3,781,745 A * 12/1973 Vadnagara ..... H01H 85/042 337/199
3,818,407 A * 6/1974 Edgerton ..... H01H 85/56 337/199
3,829,810 A * 8/1974 Giegerich ..... H01B 17/005 337/202
4,060,785 A * 11/1977 Hanke ..... H01H 85/2045 337/201

(Continued)

*Primary Examiner* — Briggitte R. Hammond
(74) *Attorney, Agent, or Firm* — Kevin D. Everage

(57) ABSTRACT

A fused tap for an elbow connector that properly insulates and houses an interruption device or fuse to provide protection on underground distribution power lines. The interruption device is replaceable without the need of replacing the entire assembly. The fused tap provides flexibility in installation for existing and new underground distribution lines and/or feeders.

20 Claims, 4 Drawing Sheets

(56) References Cited

U.S. PATENT DOCUMENTS

| | | | | |
|---|---|---|---|---|
| 4,857,021 | A * | 8/1989 | Boliver | H01R 13/53 439/801 |
| 6,364,216 | B1 * | 4/2002 | Martin | H01R 13/53 439/181 |
| 6,491,548 | B2 * | 12/2002 | Stepniak | H01H 9/102 337/202 |
| 7,445,480 | B2 * | 11/2008 | Whyte | H01R 13/53 439/250 |
| 7,572,133 | B2 * | 8/2009 | Hughes | H01H 33/66207 439/181 |
| 7,695,291 | B2 * | 4/2010 | Hughes | G01R 31/07 439/181 |
| 8,282,410 | B2 * | 10/2012 | Siebens | H01R 13/53 439/362 |

* cited by examiner

SINGLE PHASE UNDERGROUND FUSED TAP

CROSS REFERENCE TO RELATED APPLICATIONS

This application claims priority to U.S. Provisional Appln. No. 62/622,763 filed Jan. 26, 2018 entitled "Fused Elbow", which application is expressly incorporated by reference herein.

FIELD OF THE INVENTION

The present invention relates to a fused electrical tap. More particularly the present invention relates to a canister fuse holder that provides ease for fuse placement and/or replacement of fuses and does not require any type of cable terminations.

BACKGROUND

This invention relates generally to underground and above-ground distribution systems and underground and above-ground cable connections. The invention provides protection and isolation for those systems. The increasing use of underground electrical distribution for residential, industrial, and commercial purposes has created the need for more reliable sectionalizing and protection options.

Currently there are limited methods and apparatus to provide in-line fusing for underground distribution applications. The methods and apparatus currently available require users to re-terminate cables in order to add in-line fusing, resulting in more time and man-hours to prepare cable ends and wasted materials by discarding the existing terminations. These processes may take about 30 minutes to about 2 hours to complete by a person of ordinary skill in the art according to known methods. As a result, power outages extend for longer periods of time than necessary.

SUMMARY OF THE INVENTION

The following description illustrates the invention by way of example and not by way of limitation. The description enables one skilled in the art to make and use the invention in what is presently believed to be the best mode of use for the invention.

The present invention eliminates existing difficulties and disadvantages by providing a new fused tap for an elbow connector that does not require any cable re-termination and the capability to be installed in either new or already existing underground or above-ground electrical distribution equipment.

The design of invention provides several advantages. The in-line fused tap can be changed out with general ease in case of the need for maintenance or replacement if the fuse has blown, damaged, or diminished to inadequate performance. Additionally, the invention allows users to install the apparatus on existing underground or above-ground distribution equipment, including but not limited to the most common voltage classes, regardless of cable size, with minimal loss of time. Installation and/or fuse replacement times using the invention and disclosed methods may be reduced to a couple of minutes from the present duration which spans about 30 minutes to about 2 hours. More specifically, one of ordinary skill in the art may use the disclosed invention and methods to perform a fuse installation or fuse replacement in about 2 minutes. At the longer end of the range of times for one of ordinary skill in the art using the disclosed invention and methods, a fuse installation or fuse replacement should take no more than 5 minutes.

DETAILED DESCRIPTION OF THE PREFERRED EMBODIMENTS

Figure 1:
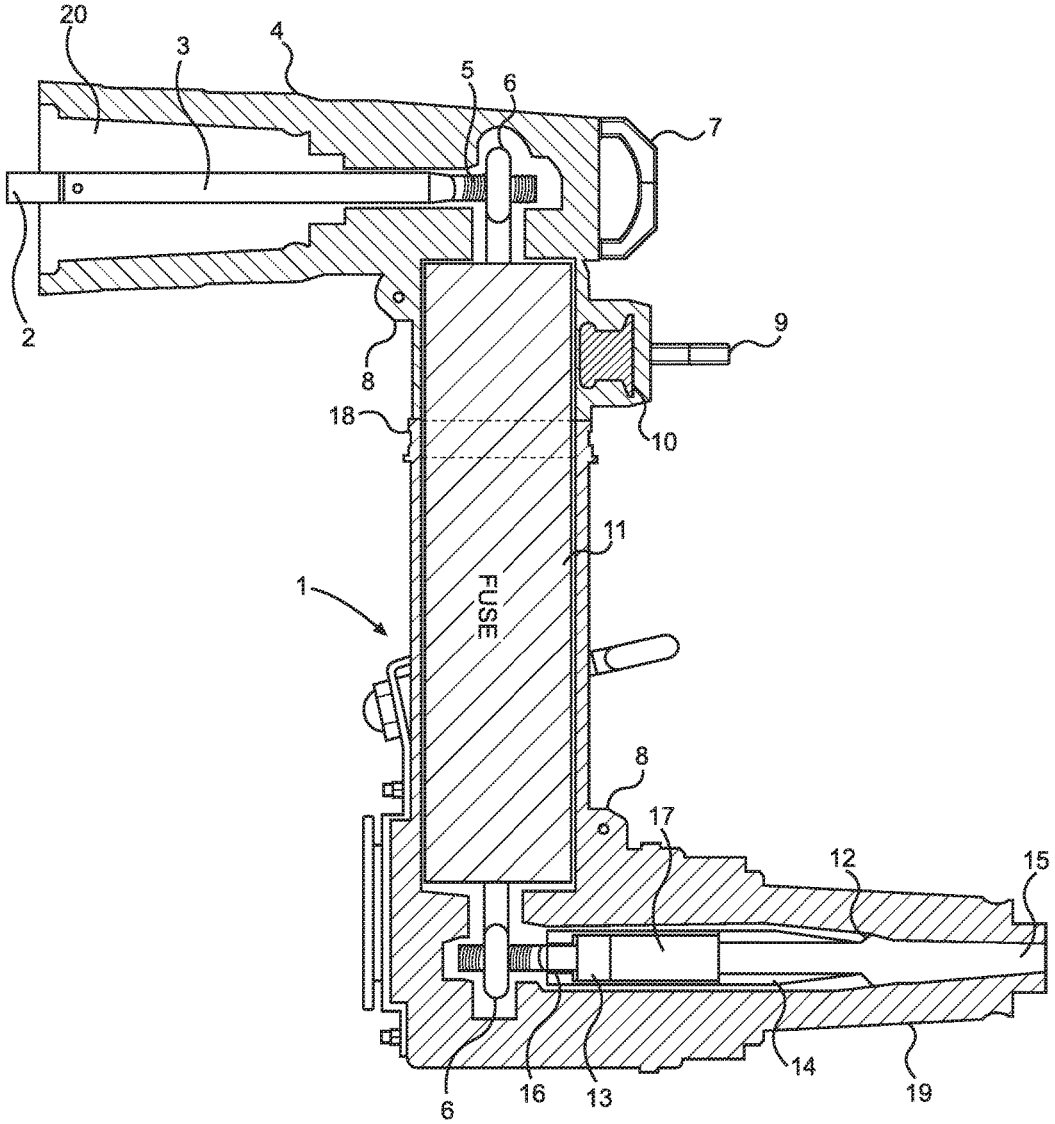
FIG. 1 is a cross-sectional view of a fused tap according to the present invention.
Figure 2:
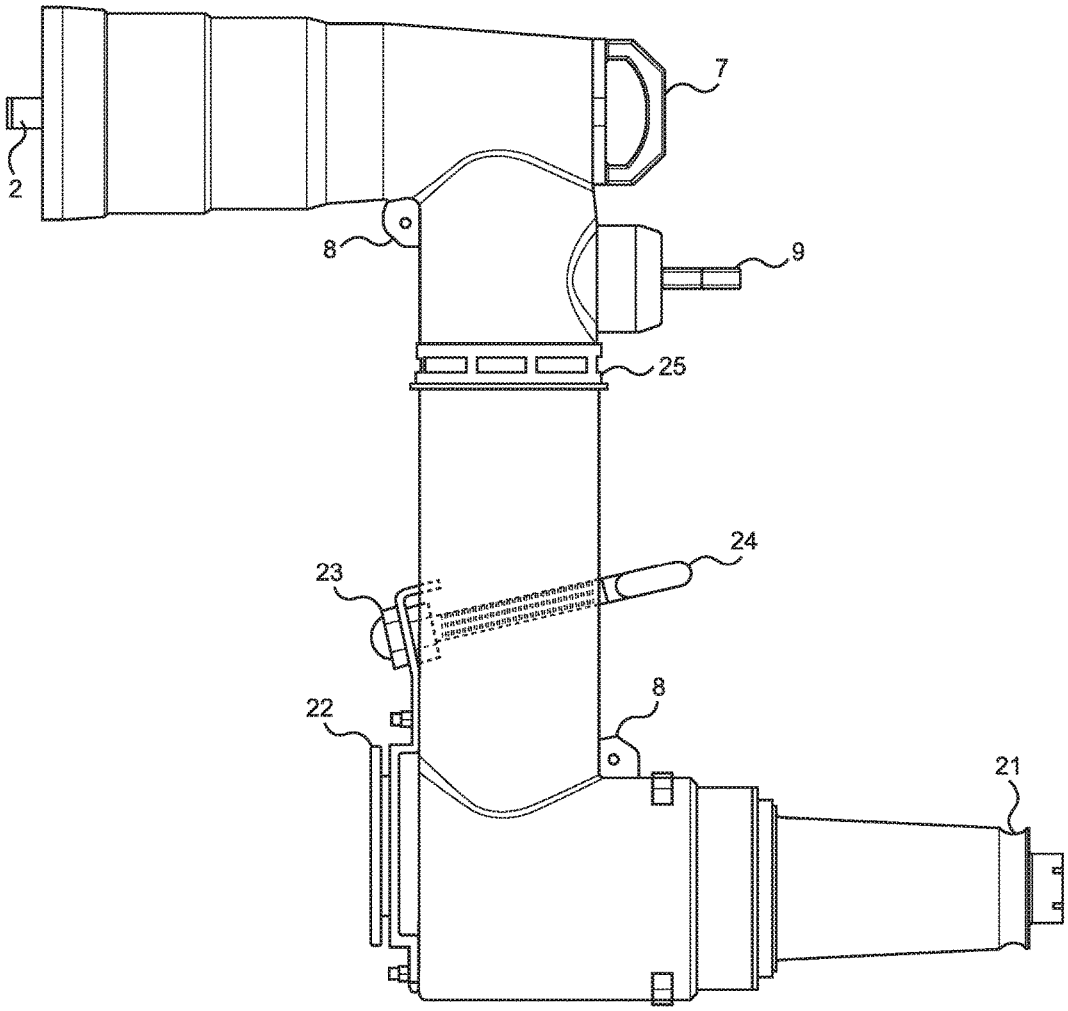
FIG. 2 is a perspective view of a prototypical embodiment of a fused tap.

The above and other capabilities, aspects, and advantages of the invention will be discussed in the detailed description below. The detailed descriptions are to be considered in conjunction with the accompanying drawings in which identical reference characters designate like elements throughout the views.

Shown in FIG. 1 is a fused tap 1 which provides connections to equipment using a female elbow interface 20 and a male elbow interface 19. The fused tap provides connection between two apparatus bushings and adds a protective fuse 11 between the two. Not having to terminate these connections allows for quick and safe installation that can be either a temporary or long-term installation.

This fused tap 1 design comprises a housing defined by a molded rubber sleeve. The housing can be split into two parts by pulling apart the connection between male elbow interface 19 and female elbow interface 20 at the interface of the respective tube ends 18 in order to replace the fuse 11. Once the fuse 11 has been replaced the housing is secured with an external clamp 25.

Connections to the fuse 11 are made on either end through the threaded terminals 6. On the female elbow interface 20 the fuse 11 makes an electrical connection through the threaded conductor 5 which is connected to the probe 3 and the probe tip 2. The probe tip 2 acts as a guide when inserting the fused tap 1 for installation. An insulating body 4 surrounds the threaded conductor 5 and the fuse's threaded terminal 6. The fuse 11 is contained within the housing of the sleeve and on the male elbow interface 19 connects to a threaded nut conductor 13 that screws into the fuse 11 threaded terminal 6. The threaded nut conductor 13 is mechanically housed within a metal conductor casing 17 to provide an electrical connection between the threaded nut conductor 13 and an external bushing probe that inserts into the probe interface 15. The metal conductor casing 17 is designed with a guide gap 16 that aids when screwing the threaded nut connector 13 to the fuse 11 threaded terminal 6. When an external bushing probe is inserted into the probe interface 15 electrical contact is made between the external bushing probe and the contact assembly 14. The external bushing probe assembly is positioned into place by guides 12 attached to the front of the contact assembly 14.

An external bushing is plugged into the male elbow interface 19 to provide connections to new or existing underground or above-ground elbow connections. The locking groove 21 grips the external bushing probe to keep the external bushing probe in place. Before plugging in the external bushing probe, the fused tap 1 must be secured using the parking bracket 22. Once the fused tap 1 is in the parking bracket 22, the bolt 24 is used to tighten the nut 23 and provide support by a strong force pressing against the outer surface of the fused tap 1. The pulling eye 7 on the fused tap 1 allows assembly to, and removal from, the external bushing probe with the aid of a live line tool or, "hot stick."

The fused tap 1 has several features to improve personnel safety when the fused tap 1 has been energized. The voltage test plug 9 can be removed to test for the presence of voltage at the capacitive voltage tap 10. The fused tap 1 can be grounded at the two grounding eye S locations.

Figure 3:
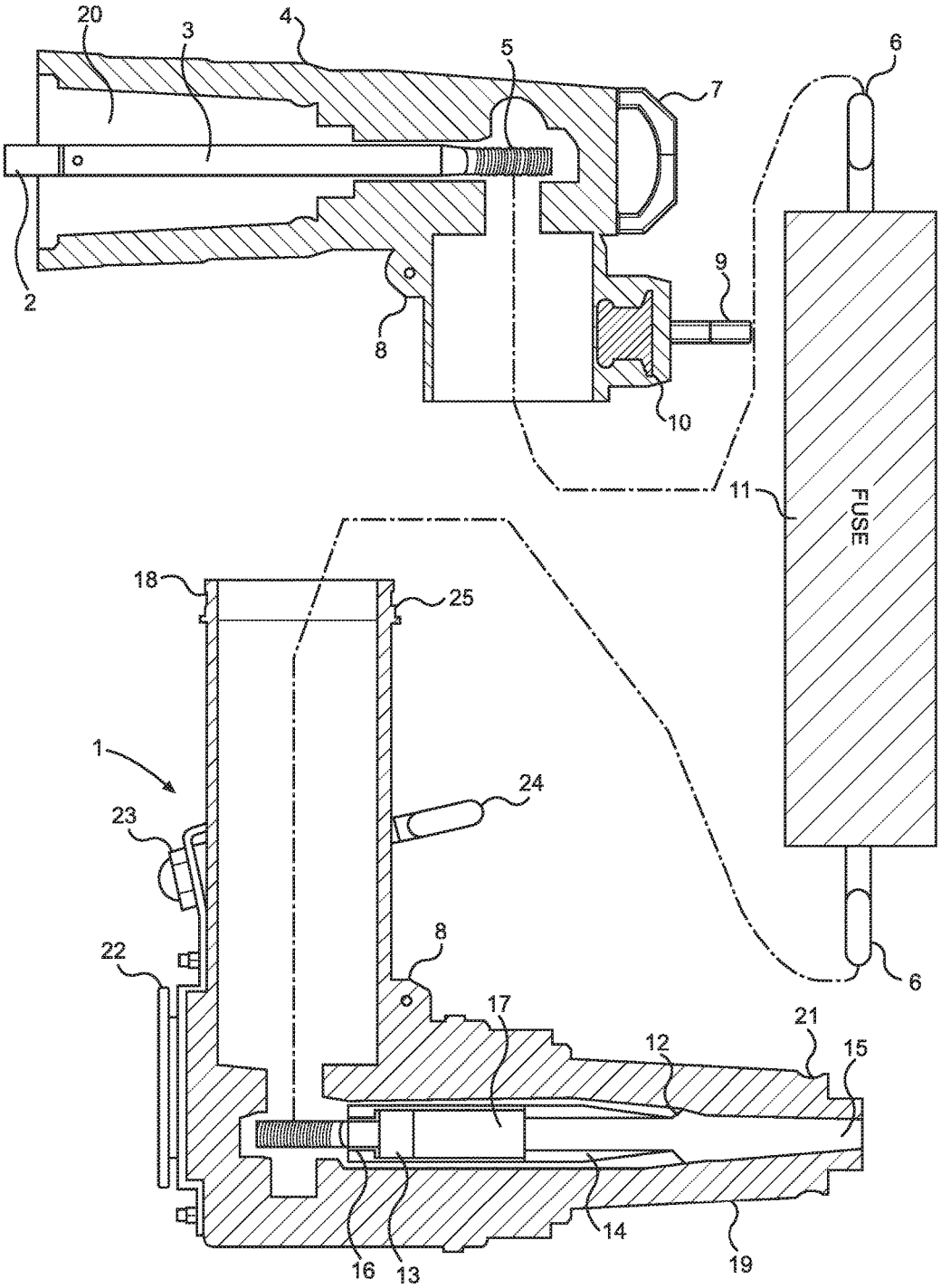
FIG. 3 is a cross-sectional view of a disassembled fused tap according to FIG. 1 of the present invention.
Figure 4:
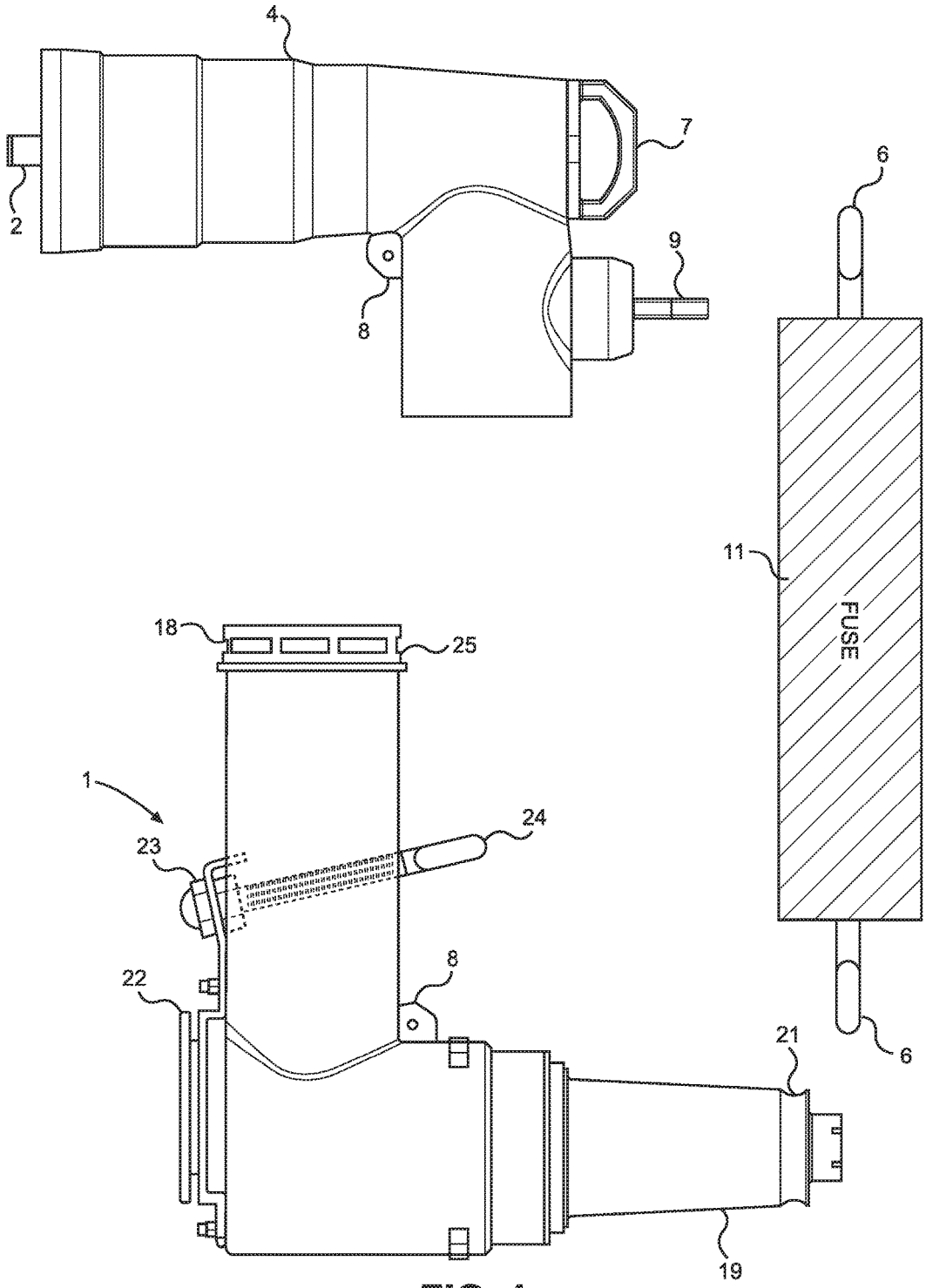
FIG. 4 is a perspective view of a disassembled fused tap according to FIG. 2 of the present invention.

In a preferred method of making and using the present invention, FIGS. 3 and 4 show the internal and external features of the disassembled parts of a fused tap 1. The user inserts one threaded terminal 6 of the fuse 11 into female elbow interface 20 and screws the threaded conductor 5 of probe 3 into threaded terminal 6 creating an electrical connection between the fuse 11 and probe 3. The user inserts the other threaded terminal 6 of the fuse 11 into male elbow interface 19 and screws the threaded nut conductor 13 into threaded terminal 6 creating an electrical connection between the fuse 11 and threaded nut conductor 13. The molded rubber sleeve housing of male elbow interface 19 is inserted into female elbow interface 20 creating a mating between the two at tube ends 18. The connection is secured by external clamp 25.

The fused tap 1 is secured using the parking bracket 22. Once the fused tap 1 is in the parking bracket 22, the bolt 24 is used to tighten the nut 23 and provide support by a strong force pressing against the outer surface of the fused tap 1. An external bushing probe is then inserted into the probe interface 15 to provide connections to new or existing underground or above-ground elbow connections. When an external bushing probe is inserted into the probe interface 15 electrical contact is made between the external bushing probe and the contact assembly 14. The external bushing probe assembly is positioned into place by guides 12 attached to the front of the contact assembly 14. The locking groove 21 grips the external bushing probe to keep the external bushing probe in place. The pulling eye 7 on the fused tap 1 allows assembly to, and removal from, the external bushing probe with the aid of a live line tool or, "hot stick."

The fused tap 1 is energized to complete the installation. As a safety measure, the voltage test plug 9 can be removed to test for the presence of voltage at the capacitive voltage tap 10. The fused tap 1 is grounded at the two grounding eye 8 locations to de-energize the fused tap 1 if the parts need to be disassembled or a new fuse replaced into the assembly.

What is claimed is:

1. An apparatus comprising:

a first insulated interface covering a first conductive probe tip comprising a first metal conductor casing having a threaded first probe end, the first insulated interface having a first molded rubber sleeve end;

a second insulated interface covering a second conductive probe tip comprising a second metal conductor casing having a threaded second probe end, the second insulated interface having a second molded rubber sleeve end;

a fuse having a first conductive end and a second conductive end;

the first conductive end and the second conductive end comprising threaded terminals;

the first conductive end of the fuse connecting to the first conductive probe tip;

the second conductive end of the fuse connecting to the second conductive probe tip;

the second molded rubber sleeve end inserted into the first molded rubber sleeve end;

the threaded first probe end configured to electrically connect to the first conductive end by screwing into the threaded terminal of the first conductive end; and the threaded second probe end configured to electrically connect to the second conductive end by screwing into the threaded terminal of the second conductive end.

2. A method comprising:

providing a first insulated interface covering a first conductive probe tip comprising a first metal conductor casing having a threaded first probe end, the first insulated interface having a first molded rubber sleeve end;

providing a second insulated interface covering a second conductive probe tip comprising a second metal conductor casing having a threaded second probe end, the second insulated interface having a second molded rubber sleeve end;

providing a fuse having a first conductive end and a second conductive end;

the first conductive end and the second conductive end comprising threaded terminals;

electrically connecting the first conductive end of the fuse to the first conductive probe tip by screwing the first threaded probe end into the threaded terminal of the first conductive end;

electrically connecting the second conductive end of the fuse connecting to the second conductive probe tip by screwing the second threaded probe end into the threaded terminal of the second conductive end; and inserting the second molded rubber sleeve end into the first molded rubber sleeve end.

3. The apparatus of claim 1, wherein the first molded rubber sleeve end of the first insulated interface is configured to receive the second molded rubber sleeve end of the second insulated interface in a male-female connection mechanism.

4. The apparatus of claim 3, further comprising an external clamp to releasably secure the connection between the first insulated interface and second insulated interface.

5. The apparatus of claim 4, further comprising a parking bracket releasably secured to the apparatus by a nut and bolt assembly pressing against the outer surface of the apparatus to releasably secure the apparatus in a fixed position.

6. The apparatus of claim 5, further comprising a locking groove configured to releasably connect an external bushing probe to the second insulated interface.

7. The apparatus of claim 6, further comprising guides attached to the front of a contact assembly of the second metal conductor casing disposed within the second insulated interface for positioning the external bushing probe into electrical contact with the contact assembly.

8. The apparatus of claim 6, further comprising a pulling eye to allow insertion or removal of an external bushing probe from the second insulated interface.

9. The apparatus of claim 8, further comprising an external bushing removably connected to the locking groove to provide electrical connections to new or existing lines.

10. The apparatus of claim 1, further comprising a voltage test plug for testing the presence of voltage at a capacitive voltage tap.

11. The apparatus of claim 1, further comprising a grounding eye affixed to each of the first insulated interface and second insulated interface.

12. The method of claim 2, wherein the second molded rubber sleeve end of the second insulated interface is inserted into the first molded rubber sleeve end of the first insulated interface in a male-female connection mechanism.

13. The method of claim 12, further comprising the step of releasably securing the connection between the first insulated interface and second insulated interface with an external clamp.

14. The method of claim 13, further comprising the step of releasably securing the apparatus in a fixed position relative to a parking bracket by pressing a nut and bolt against the outer surface of the apparatus.

15. The method of claim 14, further comprising the step of releasably connecting an external bushing probe to the second insulated interface by pressing the external bushing probe into a locking groove on the second insulated interface.

16. The method of claim 15, further comprising the step of positioning the external bushing probe into electrical contact with a contact assembly of the second metal conductor casing disposed within the second insulated interface by inserting the external bushing probe into contact with guides attached to the front of the contact assembly.

17. The method of claim 15, further comprising the step of affixing a pulling eye to the first insulated interface to allow insertion or removal of an external bushing probe from the second insulated interface.

18. The method of claim 17, further comprising the step of removably connecting an external bushing to the locking groove to provide electrical connections to new or existing lines.

19. The method of claim 2, further comprising the step of testing for the presence of voltage at a capacitive voltage tap with a voltage test plug.

20. The method of claim 2, further comprising the step of affixing a grounding eye to each of the first insulated interface and second insulated interface.

* * * * *